US009186699B2

(12) United States Patent
Heo et al.

(10) Patent No.: US 9,186,699 B2
(45) Date of Patent: Nov. 17, 2015

(54) CURING APPARATUS

(71) Applicant: LG DISPLAY CO., LTD., Seoul (KR)

(72) Inventors: Jaeyeol Heo, Paju-si (KR); Ojun Kwon, Paju-si (KR); Kyengbaek Ryu, Paju-si (KR); Hoonseok Kang, Paju-si (KR); Jongho Song, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 365 days.

(21) Appl. No.: 13/728,730

(22) Filed: Dec. 27, 2012

(65) Prior Publication Data

US 2014/0061508 A1 Mar. 6, 2014

(30) Foreign Application Priority Data

Aug. 31, 2012 (KR) ..... 10-2012-0096377

(51) Int. Cl.

| | |
|---|---|
| ***F26B 19/00*** | (2006.01) |
| ***F26B 3/30*** | (2006.01) |
| ***B05D 3/06*** | (2006.01) |

(52) U.S. Cl.

CPC . *B05D 3/06* (2013.01); *B05D 3/067* (2013.01)

(58) Field of Classification Search

None

See application file for complete search history.

(56) References Cited

U.S. PATENT DOCUMENTS

| | | | | |
|---|---|---|---|---|
| 4,755,654 | A * | 7/1988 | Crowley et al. | 219/405 |
| 6,849,831 | B2 * | 2/2005 | Timans et al. | 219/390 |
| 7,509,035 | B2 * | 3/2009 | Ranish et al. | 392/416 |
| 8,295,691 | B2 * | 10/2012 | Kusuda | 392/418 |
| 8,314,368 | B2 * | 11/2012 | Ranish et al. | 219/405 |
| 8,859,443 | B2 * | 10/2014 | Yokouchi | 438/796 |
| 8,901,518 | B2 * | 12/2014 | Ranish et al. | 250/492.1 |
| 2002/0030047 | A1 * | 3/2002 | Shao et al. | 219/390 |
| 2002/0067918 | A1 * | 6/2002 | Camm et al. | 392/416 |
| 2004/0125593 | A1 * | 7/2004 | Nam | 362/92 |
| 2010/0018960 | A1 * | 1/2010 | Gat et al. | 219/405 |
| 2010/0074604 | A1 * | 3/2010 | Koelmel et al. | 392/408 |
| 2011/0123178 | A1 * | 5/2011 | Aderhold et al. | 392/416 |

* cited by examiner

*Primary Examiner* — Thor Campbell

(74) *Attorney, Agent, or Firm* — Brinks Gilson and Lione

(57) ABSTRACT

An exemplary embodiment of the present invention provides a curing apparatus comprising: a cassette; lamps configured in the cassette; a lamp housing having lamp accommodating portions disposed within the cassette to accommodate the lamps; and window plates separately configured so as to correspond to the positions of the lamp accommodating portions.

17 Claims, 9 Drawing Sheets when conventional window plate is applied when window plate of exemplary embodiment is applied

CURING APPARATUS

This application claims the benefit of Korean Patent Application No. 10-2012-0096377 filed on Aug. 31, 2012, which is incorporated by reference in its entirety.

BACKGROUND

1. Field

This document relates to a curing apparatus.

2. Related Art

In a display device such as an organic light emitting display (OLED), an electrophoretic display (EPD), and a liquid crystal display (LCD), elements or lines are formed by depositing a thin film.

The above mentioned display devices require a curing process for forming a solid thin film after a deposition process. An example of a curing apparatus used in manufacturing a display device includes a chamber type in which a cassette structure is stacked in multiple stages.

Each cassette has a lamp configured therein which allows the temperature in the cassette to increase from ambient temperature to high temperature. Such a cassette is usually designed such that a single or multiple target substrates are put therein.

A window plate is applied to each cassette to uniformly radiate heat generated from the lamp and prevent the formation of smears in the target substrates. The window plate performs a variety of functions including isolating a process zone where the target substrates are located and a lamp zone.

To this end, the window plate is made of large-size, plate-like quartz. The plate-like window plate is configured by being fitted to a slot formed at a side of each cassette.

However, it is difficult to fabricate a large-area curing apparatus because the window plate applied to each cassette is in the shape of a large-size plate. For instance, if deflection prevention is performed on the window plate to realize a large-area window plate, there follows the difficulty of thickness compensation or structure addition. Moreover, investment cost is expected to rise due to an increase in material and processing costs because it is difficult to fabricate a large-size, plate-like window plate. Therefore, there is a need to seek a solution for fabricating the window plate applied to a conventional curing apparatus to have a larger area.

SUMMARY

An exemplary embodiment of the present invention provides a curing apparatus comprising: a cassette; lamps configured in the cassette; a lamp housing having lamp accommodating portions disposed within the cassette to accommodate the lamps; and window plates separately configured so as to correspond to the positions of the lamp accommodating portions.

BRIEF DESCRIPTION OF THE DRAWINGS

The accompanying drawings, which are included to provided a further understanding of the invention and are incorporated on and constitute a part of this specification illustrate embodiments of the invention and together with the description serve to explain the principles of the invention.

DETAILED DESCRIPTION

Reference will now be made in detail embodiments of the invention examples of which are illustrated in the accompanying drawings Hereinafter, a concrete exemplary embodiment of the present invention will be described with reference to the accompanying drawings.

Figure 1:
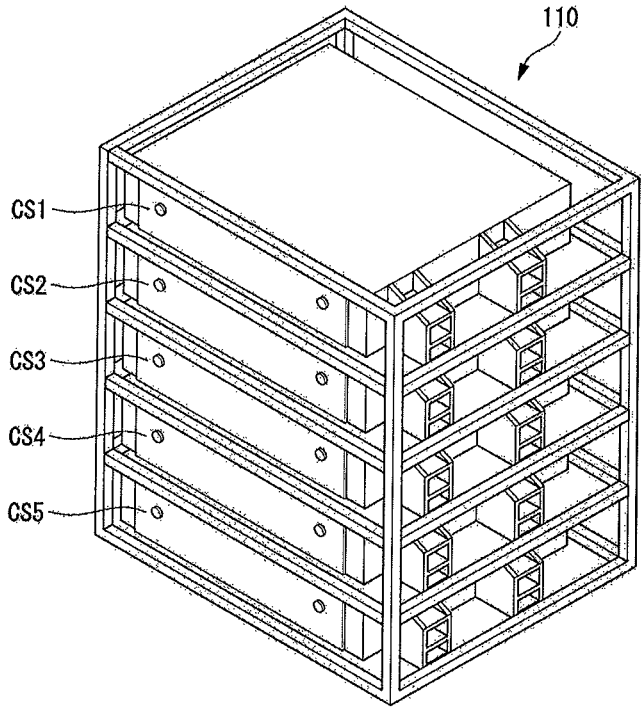
FIG. 1 is a view showing a curing apparatus according to an exemplary embodiment of the present invention.
Figure 2:
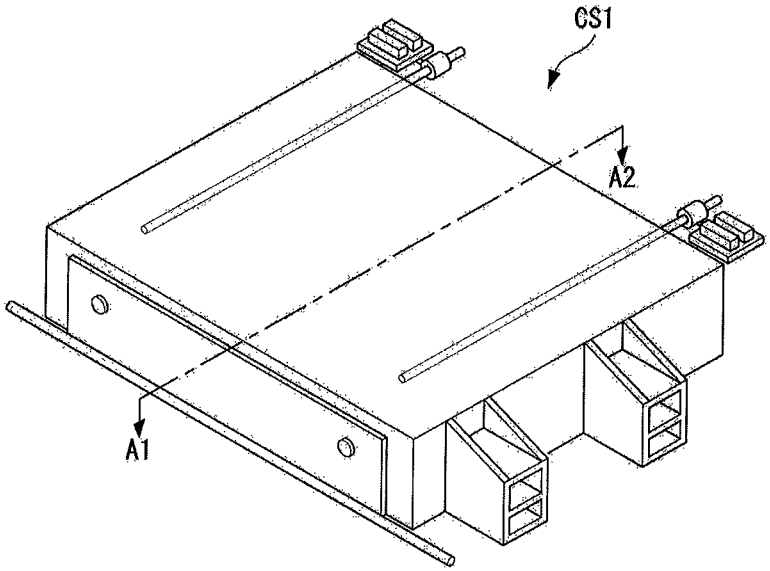
FIG. 2 is a view showing a cassette shown in FIG. 1.

As shown in FIGS. 1 and 2, a curing apparatus according to an exemplary embodiment of the present invention is implemented as a chamber type having first to fifth cassettes CS1 to CS5 accommodated in multiple stages in the chamber 110. However, the curing apparatus according to the exemplary embodiment of the present invention may be implemented such that only one cassette is accommodated in the chamber 110 or more cassettes than those shown in the drawing are accommodated therein.

The curing apparatus according to the exemplary embodiment of the present invention is capable of performing a curing process using the first to fifth cassettes CS1 to CS5 accommodated in the chamber 110. Although the first to fifth cassettes CS1 to CS5 can respectively perform the curing process, the present invention is not limited thereto.

The curing apparatus according to the exemplary embodiment of the present invention can perform a heat treatment process on a substrate (polyimide, oxide, photoresist, etc) used for a display device such as an organic light emitting display (OLED), an electrophorestic display (EPD), a liquid crystal display (LCD), and a stereoscopic image display device.

Several examples of which will be considered. The curing apparatus according to the exemplary embodiment of the present invention may be used for low-temperature polysilicon (LTPS) activation, dehydrogenation/hydrogenation, and pre-compaction processes.

The first cassette CS1 will now be described respectively for the configuration of the first to fifth cassettes CS1 to CS5 included in the curing apparatus according to the exemplary embodiment of the present invention.

Figure 3:
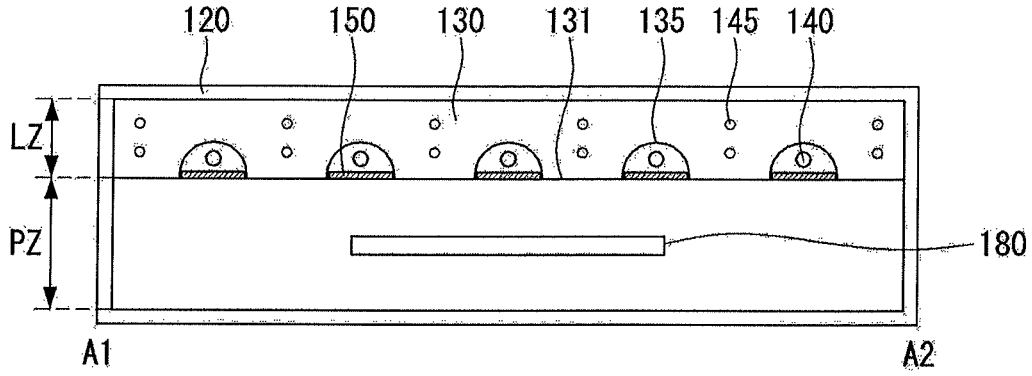
FIG. 3 is an illustration of a first cross-section of region A1-A2 of FIG. 2.
Figure 4:
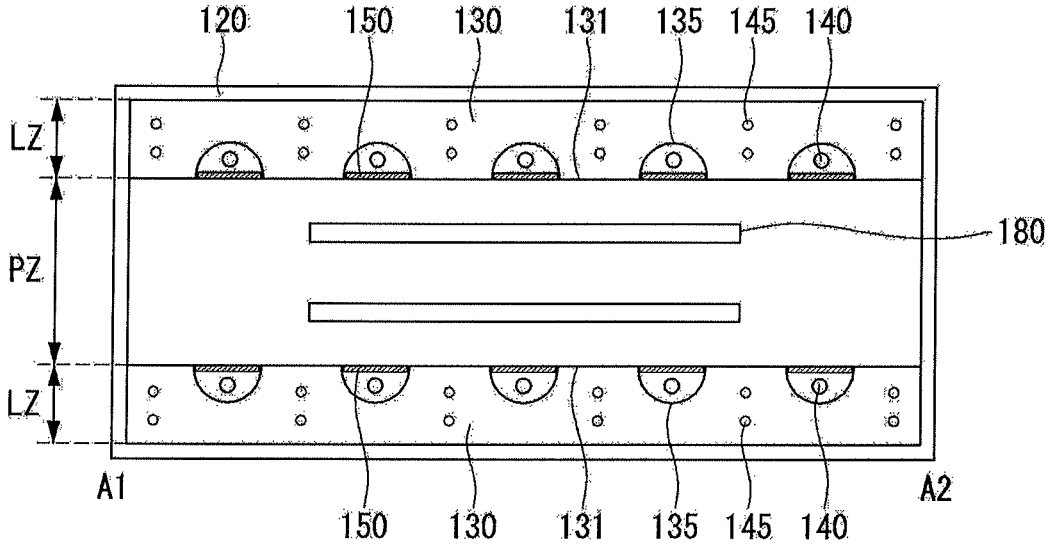
FIG. 4 is an illustration of a second cross-section of region A1-A2 of FIG. 2.

As shown in FIGS. 3 and 4, the first cassette CS1 included in the curing apparatus according to the exemplary embodiment of the present invention comprises a cassette body 120, a lamp housing 130, cooling portions 145, lamps 140, and window plates 150.

The space occupied by the lamp housing 130, the lamps 140, and the window plates 150 is included in a lamp zone LZ, and the remaining space is included in a process zone PZ.

The lamp zone LZ serves as a space where heat generated from the lamps 140 is radiated to the process zone PZ, and the process zone PZ serves as a space where a heat treatment process is performed on a target substrate. The first cassette CS1 may be implemented as a structure (FIG. 3) where the lamp zone LZ is located at an upper part (or lower part) or a structure (FIG. 4) where the lamp zone LZ is locate at upper and lower parts. FIG. 3 is defined as a multi-cassette single slot structure, and FIG. 4 is defined as a multi-cassette multi-slot structure.

The lamp housing 130 is configured at the upper end inside the first cassette CS1. The lamp housing 130 has the lamp accommodating portions 135 that accommodate the lamps 140. The lamp accommodating portions 135 have recesses which are concaved from an exposed bottom surface 131 of the lamp housing 130. Although the recesses have various shapes including a triangle, a rectangle, a polygon, a semicircle, and an ellipse, they are in the shape of a semicircle by way of example in the exemplary embodiment of the present invention.

The lamps 140 are configured within the lamp accommodating portions 135. The lamps 140 generate heat by electric power supplied to the first cassette CS1. The lamps 140 may radiate short, intermediate, and long wavelengths. If the lamps 140 radiate a long wavelength of 1.5 μm or greater, ozone O3 is not generated. This may prevent corrosion of the parts configured on the first cassette CS1 and make curing slower.

The cooling portions 145 cool the heat generated from the lamps 140. The cooling portions 145 may be of an air cooling type or water cooling type. Although the cooling portions 145 are configured between the lamp accommodating portions 135 by way of example, the present invention is not limited thereto.

The window plates 150 are separately configured so as to correspond to the positions of the lamp accommodating portions. The window plates 150 serve to separate (isolate) the lamp zone LZ and the process zone PZ. Moreover, the window plates 150 serve to uniformly spread and radiate the heat generated from the lamps 140.

The window plates 150 are made of a material with high light transmittance and low absorptivity. For example, the window plates 150 may be made of quartz, sodalime, or graphite.

Figure 5:
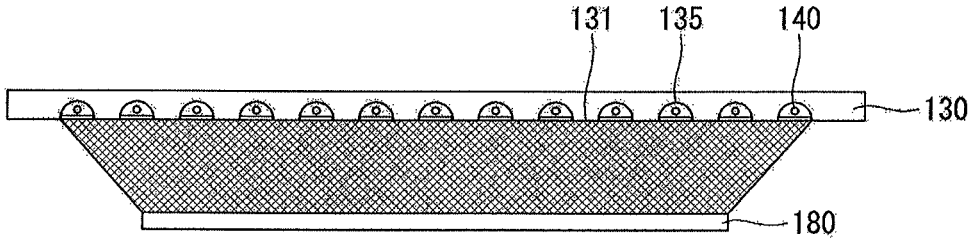
FIG. 5 is a cross-sectional view showing a pattern of heat radiation when a first cassette is used.

As shown in FIG. 5, when heat is generated after the turn-on of the lamps 140, the generated heat is radiated through the window plates 150 and transferred to one surface of the target substrate 180.

Figure 6:
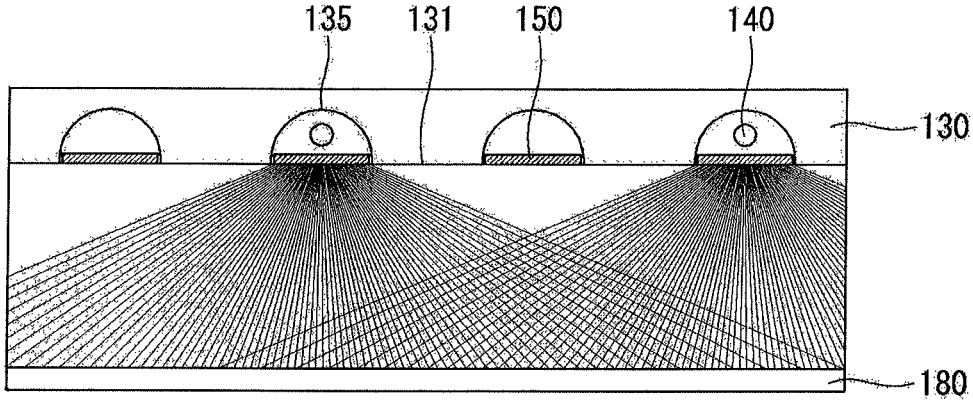
FIG. 6 is a cross-sectional view showing a simulation result of the pattern of heat radiation when the first cassette is used.

As shown in FIG. 6, when simulating every other lamp 140, it can be seen that the heat generated from the lamps 140 is uniformly radiated at various angles as it passes through the window plates 150. The radiation angle of this structure is about 70 degrees.

Figure 7:
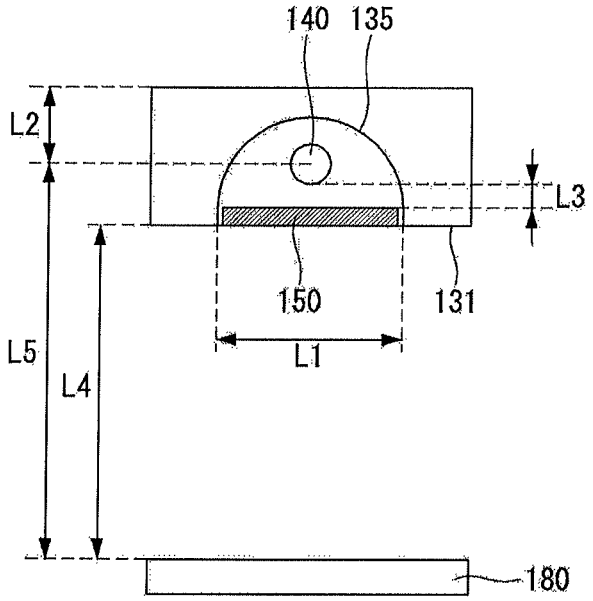
FIG. 7 is a cross-sectional view for explaining design values for the internal configuration of the first cassette.

As shown in FIG. 7, the radiation efficiency and uniformity of the heat generated from the lamps 140 is dependent upon L1 to L5. L1 denotes the distance (or diameter) of an opening part of the lamp accommodating portions 135, L2 denotes the distance from the center of the lamps 140 to the top surface of the lamp housing 130, L3 denotes the distance from the bottom of the lamps 140 to the top of the window plates 150, L3 denotes the distance from the bottom of the window plates 150 to the top of the target substrate 180, and L5 denotes the distance from the center of the lamps 140 to the top of the target substrate 180.

To show the simulation of FIG. 6, in the exemplary embodiment, L1 was 50 mm, L2 was 10 mm, L3 was 12 mm, L4 was 89.3 mm, and L5 was 101.3 mm. By optimizing the size of the lamp housing 130, the size of the lamps 140, the size of a space contacting the lamps 140, a radiation angle for radiating the heat generated from the lamps 140, and the distance to the target substrate 180 with reference to the above design values, the radiation efficiency and uniformity can be further improved.

Various structures of a lamp accommodating portion and a window plate will now be described.

Figure 8:
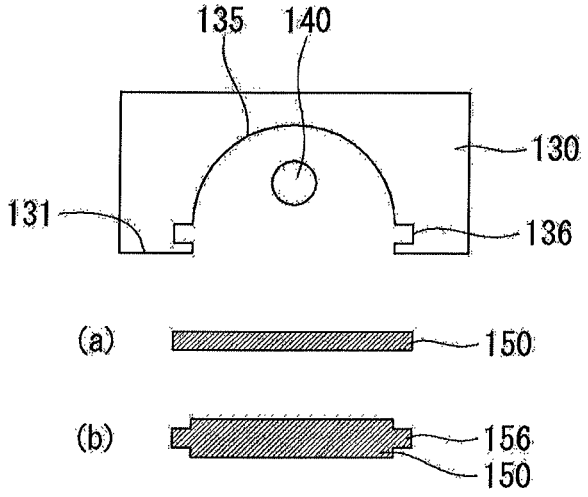
FIG. 8 is an illustration of a lamp accommodating portion and a window plate according to a first exemplary embodiment of the present invention.

As shown in FIG. 8, the lamp accommodating portion 135 has a recessed semicircular shape according to a first exemplary embodiment of the present invention. Also, the lamp accommodating portion 135 has grooves 136 which are formed at parts adjacent to the bottom surface 131 of the lamp housing 130. The grooves 136 of the lamp housing 135 have the shape of square brackets "[ ]" (concave rectangular shape) which are recessed into the inner surface of the lamp accommodating portion 135, spaced apart from the bottom surface 131 of the lamp housing 130.

As the lamp accommodating portion 135 has the above-mentioned shape, all parts of the window plate 150 have a planar shape as shown in (a). In this case, the window plate 150 of (a) is configured to be fitted to the grooves 136 of the lamp accommodating portion 135.

On the other hand, as shown in (b), only the parts of the window plate 150 to be fitted to the grooves 136 of the lamp accommodating portion 135 have convex projections 156 (convex rectangular shape), and the remaining parts have a planar shape. In this case, the window plate 150 of (b) is configured in such a manner that the projections 156 are fitted to the grooves 136 of the lamp accommodating portion 135.

Figure 9:
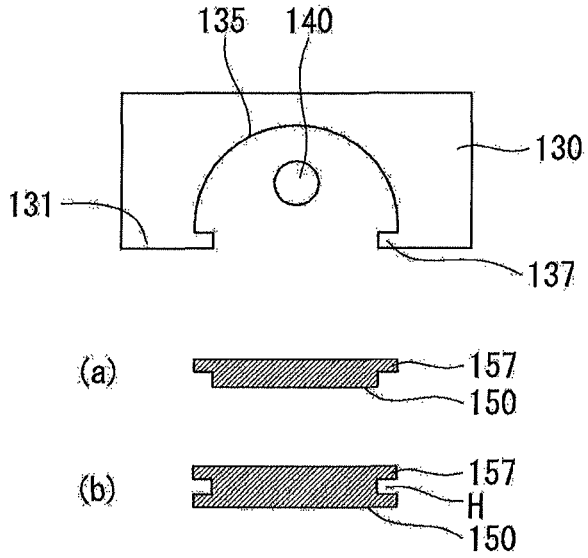
FIG. 9 is an illustration of a lamp accommodating portion and a window plate according to a second exemplary embodiment of the present invention.

As shown in FIG. 9, the lamp accommodating portion 135 has a recessed semicircular shape according to a second exemplary embodiment of the present invention. Also, the lamp accommodating portion 135 has stoppers 137 which project from the outer surface of the lamp accommodating portion 135. The stoppers 137 of the lamp accommodating portion 135 have a rectangular shape.

As the lamp accommodating portion 135 has the above-mentioned shape, only the top part of the window plate 150 to be stopped at the stoppers 137 of the lamp accommodating portion 135 has convex projections 157 (convex rectangular shape), and the remaining parts have a planar shape. In this case, the window plate 150 of (a) is configured in such a manner that the projections 157 are placed on the stoppers 137 of the lamp accommodating portion 135.

On the other hand, as shown in (b), the top and bottom parts of the window plate 150 have projections 157 (convex rectangular shape), and the remaining parts have a planar shape. In this case, the window plate 150 of (b) is configured in such a manner that concave portions H are fitted to the stoppers 137 of the lamp accommodating portion 135.

Figure 10:
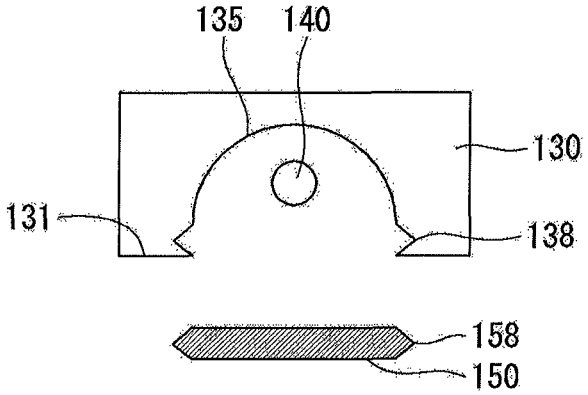
FIG. 10 is an illustration of a lamp accommodating portion and a window plate according to a third exemplary embodiment of the present invention.

As shown in FIG. 10, the lamp accommodating portion 135 has a recessed semicircular shape according to a third exemplary embodiment of the present invention. Also, the lamp accommodating portion 135 has grooves 138 which are formed at parts adjacent to the bottom surface 131 of the lamp housing 130. The grooves 138 of the lamp housing 135 have the shape of inequality signs "< >" (concave triangular shape) which are recessed at parts extending from the bottom surface 131 of the lamp housing 130 to the inner surface of the lamp accommodating portion 135.

As the lamp accommodating portion 135 has the above-mentioned shape, only the parts of the window plate 150 to be fitted to the grooves 138 of the lamp accommodating portion 135 has convex projections 158 (convex triangular shape), and the remaining parts have a planar shape. In this case, the window plate 150 is configured in such a manner that the projections 158 are fitted to the grooves 138 of the lamp accommodating portion 135.

Figure 11:
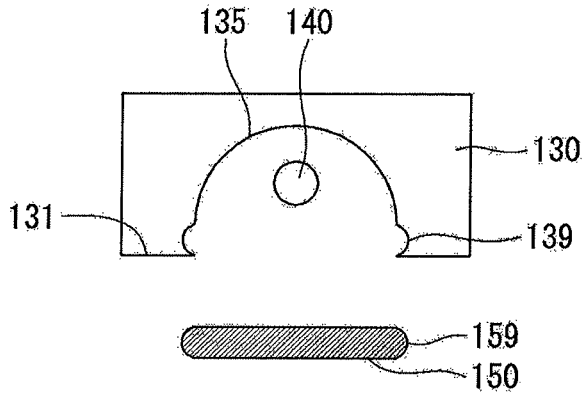
FIG. 11 is an illustration of a lamp accommodating portion and a window plate according to a fourth exemplary embodiment of the present invention.

As shown in FIG. 11, the lamp accommodating portion 135 has a recessed semicircular shape according to a fourth exemplary embodiment of the present invention. Also, the lamp accommodating portion 135 has grooves 139 which are formed at parts adjacent to the bottom surface 131 of the lamp housing 130. The grooves 139 of the lamp housing 135 have the shape of braces "( )" (concave semicircular shape) which are recessed at parts extending from the bottom surface 131 of the lamp housing 130 to the inner surface of the lamp accommodating portion 135.

As the lamp accommodating portion 135 has the above-mentioned shape, only the parts of the window plate 150 to be fitted to the grooves 139 of the lamp accommodating portion 135 has convex projections 158 (convex semicircular shape), and the remaining parts have a planar shape. In this case, the window plate 150 is configured in such a manner that the projections 158 are fitted to the grooves 139 of the lamp accommodating portion 135.

As seen from the above description, the window plate 150 may be configured in such a manner as to be placed on or fitted to the grooves 136, 138, and 139 recessed into the inner surface of the lamp accommodating portion 135 or the stoppers 137 projecting from the outer surface of the lamp accommodating portion 135. Although the window plate 150 may have a planar shape, it also may have the projections 156, 157, 158, and 159 according to the structure of the lamp accommodating portion 135. Also, the projections 156, 157, 158, and 159 of the window plate 150 may have the shape of a rectangle, a semicircle, a triangle, or a combination thereof.

A cassette embodied according to another exemplary embodiment will now be described.

Figure 12:
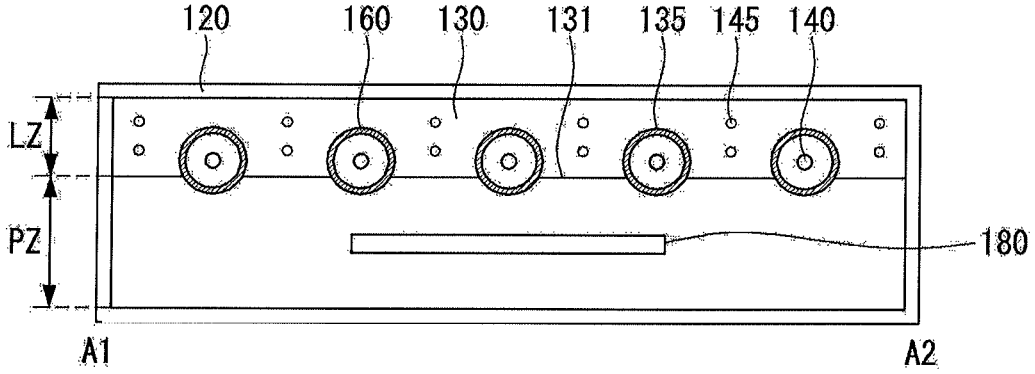
FIG. 12 is an illustration of a cross-section of a first cassette according to a fifth exemplary embodiment of the present invention.

As shown in FIG. 12, a first cassette included in a curing apparatus according to a fifth exemplary embodiment of the present invention comprises a cassette body 120, a lamp housing 130, lamps 140, and window plates 160.

According to the fifth exemplary embodiment, the window plates 160 have a circular or elliptical shape, rather than the planar shape in the first to fourth exemplary embodiments. The window plates 160 have a circular or elliptical shape, and are configured to be fitted to the lamp accommodating portions 135.

The less the window plates 160 having a circular or elliptical shape project outward, the higher coupling force they require to be fitted to the lamp accommodating portions 135.

However, if the ratio of accommodated parts and projecting parts of the window plates 160 is varied, their coupling structure may be changed as follows.

Figure 13:
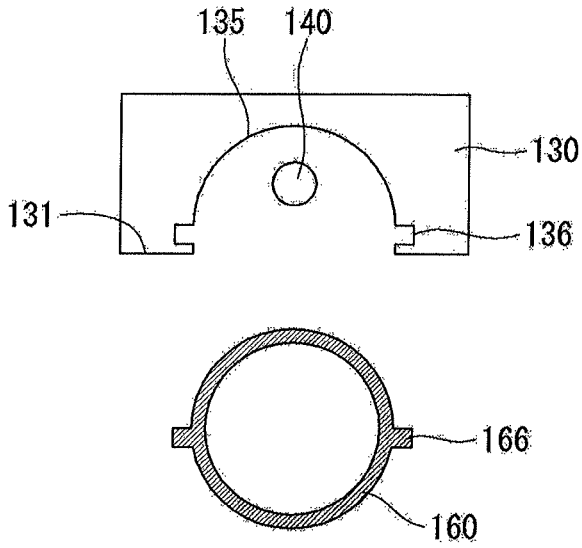
FIG. 13 is an illustration of a structure of a lamp accommodating portion and a window plate.

As shown in FIG. 13, the grooves 136 of the lamp accommodating portion 135 may have the shape of square brackets "[ ]" (concave rectangular shape) which are recessed into the inner surface of the lamp accommodating portion 135, spaced apart from the bottom surface 131 of the lamp housing 130.

As the lamp accommodating portion 135 has the above-mentioned shape, only the parts of the window plate 160 to be fitted to the grooves 138 of the lamp accommodating portion 135 has convex projections 166 (convex rectangular shape), and the remaining parts have a circular or elliptical shape. In this case, the window plate 160 is configured in such a manner that the projections 166 are fitted to the grooves 136 of the lamp accommodating portion 135.

FIG. 13 depicts an example for increasing the coupling force between the lamp accommodating portion 135 and the window plate 160. However, the grooves 136 of the lamp accommodating portion 135 and the projections 166 of the window plate 160 may have other shapes including combinations of those of the above-described first to fourth exemplary embodiments, without being limited to FIG. 13.

This will be concretely described. The grooves 136 of the lamp accommodating portion 135 may have the shape of square brackets "[ ]", braces "( )", inequality signs "< >", or a combination of these shapes. The projections 166 of the window plate 160 may have the shape of a rectangle, a semicircle, a triangle, or a combination thereof so as to correspond to the grooves 136 of the lamp accommodating portion 135.

A cassette embodied according to yet another exemplary embodiment will now be described.

Figure 14:
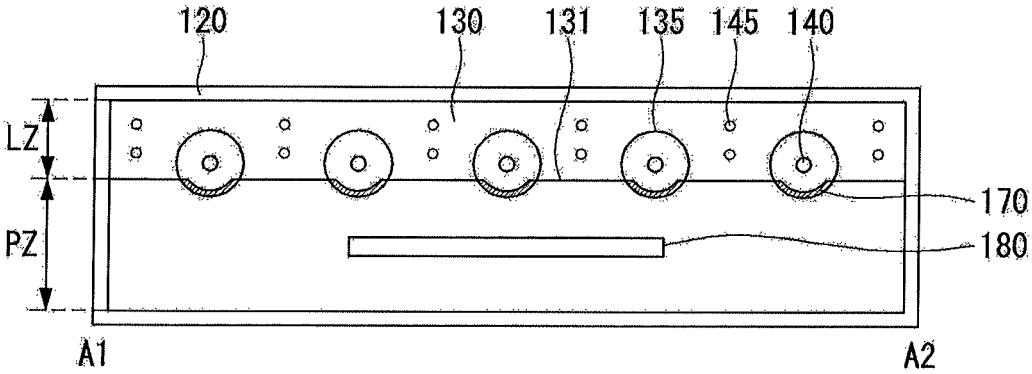
FIG. 14 is an illustration of a cross-section of a first cassette according to a sixth exemplary embodiment of the present invention.

As shown in FIG. 14, a first cassette included in a curing apparatus according to a sixth exemplary embodiment of the present invention comprises a cassette body 120, a lamp housing 130, lamps 140, and window plates 170.

According to the sixth exemplary embodiment of the present invention, some parts of the window plates 170 facing the target substrate 180 have a convex curved shape, unlike the first to fifth exemplary embodiments. The window plates 170 have a convex curved shape, and are configured to be fitted to the lamp accommodating portions 135.

Figure 15:
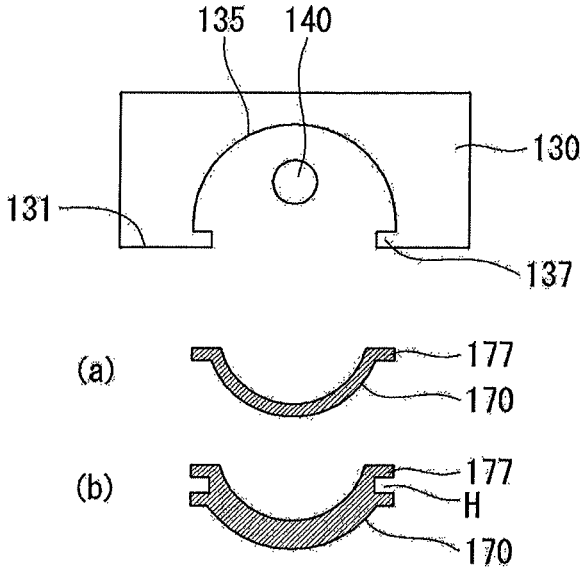
FIG. 15 is an illustration of a structure of a lamp accommodating portion and a window plate.

As shown in FIG. 15, the lamp accommodating portion 135 has a recessed semicircular shape according to the sixth exemplary embodiment of the present invention. Also, the lamp accommodating portion 135 has stoppers 137 which project from the outer surface of the lamp accommodating portion 135. The stoppers 137 of the lamp accommodating portion 135 have a rectangular shape.

As the lamp accommodating portion 135 has the above-mentioned shape, only the top part of the window plate 170 to be stopped at the stoppers 177 of the lamp accommodating portion 135 has convex projections 157 (convex rectangular shape), and the remaining parts have a convex curved shape. In this case, the window plate 170 of (a) is configured in such a manner that the projections 177 are placed on the stoppers 137 of the lamp accommodating portion 135.

On the other hand, as shown in (b), the top and bottom parts of the window plate 170 have projections 177 (convex rectangular shape), and the remaining parts have a convex curved shape. In this case, the window plate 170 of (b) is configured in such a manner that concave portions H are fitted to the stoppers 137 of the lamp accommodating portion 135.

FIG. 15 depicts an example of the lamp accommodating portion 135 and the window plate 170. However, the lamp accommodating portion 135 and the window plate 160 may have other shapes including combinations of those of the above-described first to fourth exemplary embodiments, without being limited to FIG. 15.

This will be concretely described. The lamp accommodating portion 135 may have grooves, rather than the stoppers 137. The grooves may have the shape of square brackets "[ ]", braces "( )", inequality signs "< >", or a combination of these shapes. The projections 177 of the window plate 170 may have the shape of a rectangle, a semicircle, a triangle, or a combination thereof so as to correspond to the grooves 136 of the lamp accommodating portion 135.

The advantages of using a window plate according to an exemplary embodiment over using a conventional window plate will be described below.

Figure 16:
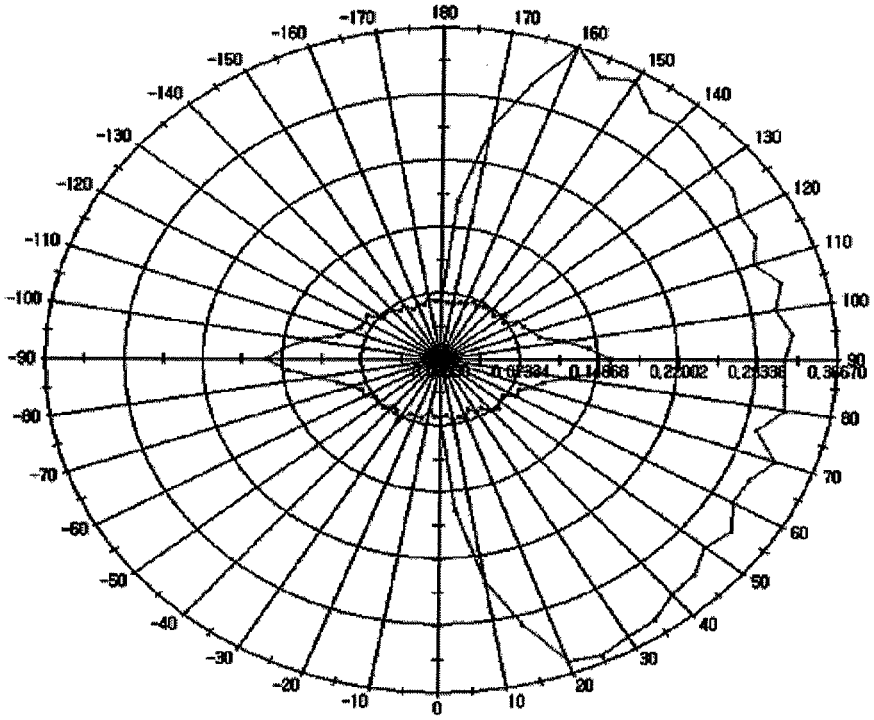
FIG. 16 is a view showing radiation angle measurement results of a conventional window plate and a window plate according to an exemplary embodiment of the present invention.
Figure 16:
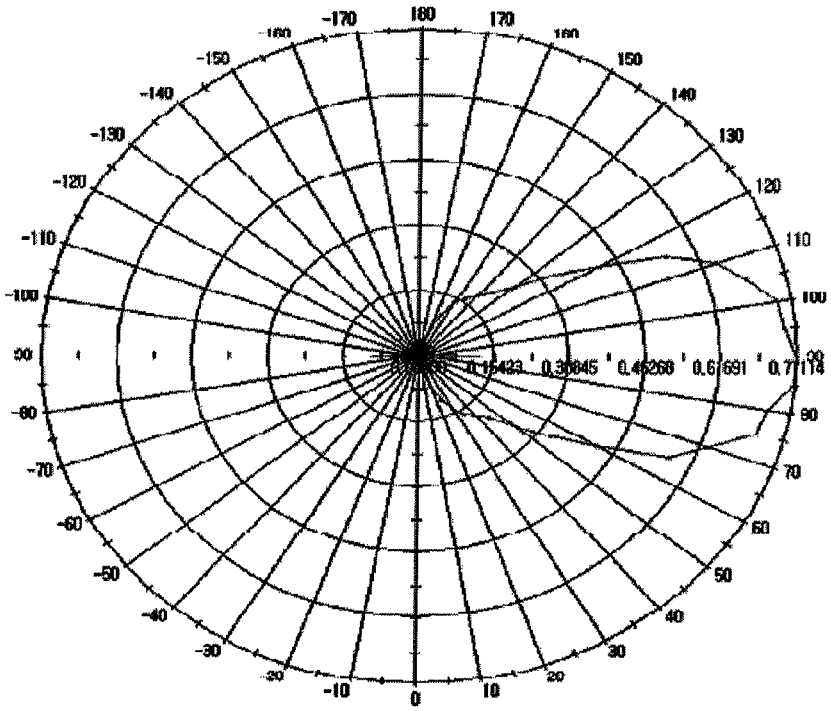

Radiation angle measurement results shown in FIG. 16 showed that the radiation angle of the conventional window plate was around 170 degrees and the radiation angle of the window plate according to the exemplary embodiment was around 70 degrees. Although not shown in FIG. 16, the radiation level of the conventional window plate was around 1.6, and the radiation level of the window plate according to the exemplary embodiment was around 1.8.

The measurement results of FIG. 17 do not represent other exemplary embodiments because they were obtained by taking an example of the structure of FIG. 3. However, as can be seen from FIG. 16, the window plate according to the exemplary embodiment showed improvement compared to the conventional window plate.

As described above, the present invention has the effect of providing a curing apparatus capable of securing ease of manufacture, cost reduction, size expandability, and process correspondence responsiveness of parts (polyimide, oxide, photoresist, etc) prior to heat treatment by arranging window plates in a multistage configuration to correspond to lamps arranged in a multistage configuration. Moreover, the present invention has the effect of providing a curing apparatus which is applicable to large-scale equipment of the fifth generation or more because a window plate can be produced in a smaller size (e.g., 30 to 200 mm) than the size of a disc (e.g., 1300*1400 mm for the 4.5th generation) used for a conventional window plate, without being limited to its size (or length). In addition, the present invention has the effect of providing a curing apparatus capable of reducing defect generation and preventing the formation of smears in a target substrate. Further, the present invention has the effect of providing a curing apparatus capable of further improving radiation efficiency and uniformity by optimizing the size of a lamp housing, the size of lamps, the size of a space contacting the lamps, a radiation angle for radiating the heat generated from the lamps, and the distance to the target substrate. Further, the present invention has the effect of providing a curing apparatus which can be freely embodied in a multi-cassette single slot structure or multi-cassette multi-slot structure. Besides, the present invention has the effect of replacing/overcoming the constraints on expanding the sizes of all equipment using lamps and window plates.

What is claimed is:

1. A curing apparatus comprising:

a cassette;

lamps disposed in the cassette;

a lamp housing having lamp accommodating portions disposed within the cassette to accommodate the lamps; and window plates separately configured so as to correspond to the positions of the lamp accommodating portions, the window plates including upper portions disposed inside the lamp accommodating portions and lower portions protruding from the lamp accommodating portions, wherein the lamps are surrounded by the window plates.

2. The curing apparatus of claim 1, wherein the window plates are configured to be placed on grooves recessed into the inner surface of the lamp accommodating portions.

3. The curing apparatus of claim 2, wherein the grooves of the lamp accommodating portions have the shape of square brackets "[ ]", inequality signs "< >", braces "( )", or a combination of these shapes.

4. The curing apparatus of claim 3, wherein the window plates comprise projections, which are formed at parts to be fitted to the grooves of the lamp accommodating portions.

5. The curing apparatus of claim 1, wherein the window plates are configured to be placed on stoppers projecting from the outer surface of the lamp accommodating portions.

6. The curing apparatus of claim 5, wherein the window plates comprise projections, which are formed at parts to be placed or fitted to the grooves of the lamp accommodating portions.

7. The curing apparatus of claim 1, wherein the window plates have the shape of curves, which are convex from a surface of the lamp housing.

8. The curing apparatus of claim 5, wherein the window plates have the shape of curves, which are convex from a surface of the lamp housing.

9. The curing apparatus of claim 4, wherein the projections of the window plates have the shape of a rectangle, a triangle, a semicircle, or a combination of these shapes.

10. The curing apparatus of claim 6, wherein the projections of the window plates have the shape of a rectangle, a triangle, a semicircle, or a combination of these shapes.

11. The curing apparatus of claim 1, wherein the window plates have a circular or elliptical shape, and are configured to be fitted to the lamp accommodating portions.

12. The curing apparatus of claim 11, wherein the window plates comprise projections which are fitted to grooves formed in the lamp accommodating portions, wherein the projections of the window plates have the shape of a rectangle, a triangle, a semicircle, or a combination of these shapes.

13. The curing apparatus of claim 1, wherein the lamps are parallel to the window plates.

14. The curing apparatus of claim 1, wherein the lamp housing is configured at the upper end inside the cassette.

15. The curing apparatus of claim 1, wherein the upper portions of the window plates conform to an inner profile of the lamp accommodating portions.

16. The curing apparatus of claim 1, wherein the lower portions of the window plates have a convex shape protruding from the lamp accommodating portions.

17. A curing apparatus comprising:

a cassette;

lamps disposed in the cassette;

a lamp housing having lamp accommodating portions disposed within the cassette to accommodate the lamps; and window plates separately configured so as to correspond to the positions of the lamp accommodating portions, the window plates including upper portions disposed inside the lamp accommodating portions and lower portions protruding from the lamp accommodating portions, wherein the lower portions each define a single inverted dome shape.

* * * * *